US009556629B2

(12) United States Patent
Bravo et al.

(10) Patent No.: US 9,556,629 B2
(45) Date of Patent: Jan. 31, 2017

(54) PRECAST CONCRETE MODULE WHICH CAN BE ADAPTED INTERNALLY TO MULTIPLE USES

(71) Applicants: Benjamin Bravo, Caguas, PR (US); Heriberto Luis Bravo, Caguas, PR (US)

(72) Inventors: Benjamin Bravo, Caguas, PR (US); Heriberto Luis Bravo, Caguas, PR (US)

( * ) Notice: Subject to any disclaimer, the term of this patent is extended or adjusted under 35 U.S.C. 154(b) by 0 days.

(21) Appl. No.: 13/960,898

(22) Filed: Aug. 7, 2013

(65) Prior Publication Data

US 2015/0040499 A1 Feb. 12, 2015

(51) Int. Cl.

| | |
|---|---|
| ***E04G 21/14*** | (2006.01) |
| ***E04B 1/348*** | (2006.01) |
| *E04B 1/35* | (2006.01) |

(52) U.S. Cl.

CPC ..... *E04G 21/142* (2013.01); *E04B 1/34823* (2013.01); *E04B 1/34861* (2013.01); *E04B 2001/3583* (2013.01)

(58) Field of Classification Search

CPC .... E04B 1/04; E04B 1/34823; E04B 1/34861; E04B 2001/3583; E04B 1/3483; E04H 9/14; E04H 9/12; E04H 1/1205; E04H 12/12

USPC ..... 52/79.1, 79.14, 292, 293.1–293.3, 169.6, 52/250

See application file for complete search history.

(56) References Cited

U.S. PATENT DOCUMENTS 2,691,291 A * 10/1954 Henderson ..... E04B 1/34823 126/500
3,201,907 A * 8/1965 Henderson ..... E04B 1/34823 52/219
3,356,183 A * 12/1967 Shell ..... B65F 1/1457 312/272.5
3,596,417 A * 8/1971 Zachry ..... E04B 1/34823 52/125.4
3,729,875 A * 5/1973 Felson ..... E04B 1/34823 52/73
3,742,660 A * 7/1973 Bierweiler ..... E04G 21/14 52/125.5
3,778,528 A * 12/1973 Heifetz ..... E04B 1/34846 52/220.2
3,842,558 A * 10/1974 Scholz ..... E02D 27/02 52/293.3
3,882,649 A * 5/1975 Mah ..... E04B 1/20 52/236.5
3,898,776 A * 8/1975 Cox ..... E04B 1/34823 52/220.1

(Continued)

*Primary Examiner* — Brian Glessner
*Assistant Examiner* — Adam Barlow
(74) *Attorney, Agent, or Firm* — Eugenio J. Torres-Oyola; Victor Rodriguez-Reyes; Ferraiuoli LLC

(57) ABSTRACT

A precast module built specifically with a dimension of 28'–0"×11'–8" vertical exterior walls 4" thick, horizontal walls 3" thick and a floor 4" thick. The horizontal walls are connected with attachment of rods to the vertical wall, while providing a number of openings in the horizontal and vertical walls allow access to the interior of the building unit and carrying out various plates weld in the top of the walls. The roof is constructed separately from the module, pouring concrete and is provided with through holes for locating screws and passes, and several welding plates to attach or connect to the roof and walls and have a connection to the roof and thus form an integral unit of construction.

7 Claims, 5 Drawing Sheets

(56) References Cited

U.S. PATENT DOCUMENTS

| | | | | | |
|---|---|---|---|---|---|
| 3,952,465 | A * | 4/1976 | Masiello | E04B 1/34823 | 52/234 |
| 3,990,197 | A * | 11/1976 | Johnston | E04G 21/161 | 52/125.2 |
| 4,195,453 | A * | 4/1980 | Komendant | E04B 1/34823 | 52/79.13 |
| 4,279,536 | A * | 7/1981 | Jarlan | E02B 3/14 | 405/21 |
| 4,539,780 | A * | 9/1985 | Rice | E04B 1/0015 | 52/169.6 |
| 4,759,158 | A * | 7/1988 | Aubry | E04B 1/34823 | 52/79.13 |
| 5,210,985 | A * | 5/1993 | Hsu | A62B 13/00 | 109/1 R |
| 5,495,695 | A * | 3/1996 | Elliott, Jr. | B65D 88/76 | 220/565 |
| 6,035,583 | A * | 3/2000 | Papke | E04B 1/12 | 52/268 |
| 6,035,585 | A * | 3/2000 | Boyd | B60S 3/00 | 52/79.1 |
| 6,260,312 | B1 * | 7/2001 | Spene | E04H 9/12 | 52/169.1 |
| 7,237,362 | B2 * | 7/2007 | Bishop | E04H 9/14 | 52/106 |
| 7,357,394 | B2 * | 4/2008 | Halverson | F41J 13/00 | 273/404 |
| 7,673,422 | B2 * | 3/2010 | De La Marche | E04B 1/34846 | 52/220.2 |
| 2011/0265395 | A1 * | 11/2011 | Chen | E04H 9/02 | 52/79.1 |

* cited by examiner

PRECAST CONCRETE MODULE WHICH CAN BE ADAPTED INTERNALLY TO MULTIPLE USES

FIELD OF INVENTION

This invention relates to a concrete module with a dimension of 28'–0"×11'–8". In its more specific aspect, this invention relates to a prefabricated concrete target for transport to the place of use as an integral unit for placement on a pillar module.

BACKGROUND

Precast concrete structures offer an alternative to conventional construction. The benefits of precast concrete structures include flexibility, feasibility and reduction of construction period. Quality of the final object is raised due to the structures which are produced in a controlled environment. Moreover, this construction is the environment due to the reduction of waste materials. These structures, once produced, can be easily transported and assembled with a minimum of time and labor.

Previous prefabricated concrete elements, formed by assembling the individual components, such as floor, walls and roof. This type of installation creates connections between elements that may cause leakage and cracking in the near future. Later U.S. Pat. No. 4,606,878 shows a prefabricated unit on the floor, three walls, and roofs were cast as an integral unit. The fourth wall is left open in order to remove the inner mold. U.S. Pat. No. 5,893,241 showed a specific unit in which the floor and perimeter walls are cast as an integral unit. The roof is a separate component that is inserted with the other unit, The U.S. Pat. No. 3,201,907 shows the construction technique, and more particularly to the use of standardized forms preformed units, made in the form of segments precast concrete molding material or other segments each having side walls and a floor or roof, and be of standardized shapes which are joined together to form buildings of various shapes and sizes.

The U.S. Pat. No. 3,596,417 "shows concrete rooms, each having an integrally molded top segment, which consists of a top panel and three side walls, and a floor panel segment, secured to the upper segment during its integral casting, are stacked on top other to form a rigid multi-story structure. The rear ends of the rooms have integrally cast cantilevered eaves so that when the rear ends of two stacks of the rooms are located adjacent to each other forming the eaves overhanging floors and roofs of the corridors defined by the space between the stacks. Room Each stack consists of an alternating long and short disposal rooms, each room having a short locking rib at its forward end for locking in an aperture formed through the front end of a room and corresponding".

The U.S. Pat. No. 3,729,875 shows "a construction of new buildings and in particular to a building consisting of a number of modular preformed sections is interlocked finesse. Until now, particularly in the conventional way of building houses, a wooderi or similar framework is first set up and then walls and trim are mounted to the main frame, the cost involved in the manufacture of such houses has risen to astronomical figures in particular of the high cost of skilled labor. In the recent past, many advances have been made in relation to manufactured homes, was to reduce the cost of labor in place. However, the cost has been moved from the site in the factory where preformed walls and floors are still made according to conventional methods. In large apartment houses, new complete precast concrete units have been produced that can be stacked on top of each other, or suspended from a main center frame. However, these larger units prefabricated are expensive to make and transport costs are sometimes formidable".

The U.S. Pat. No. 3,742,660 shows "building construction and more particularly to multi-layer precast concrete construction unit and a method of constructing buildings using such units.

The main object of this invention to provide precast concrete components that can be assembled with such accuracy and tolerance to ensure that the acceptable horizontal alignment of the structure is maintained during and after erection field unsupervised. To this end, this invention provides connections between the components for transmitting vertically stacked horizontal scissors vertical component of the vertical component corresponding below.

The invention in all its forms, the same connections used for transmitting vertical loads on a time to the part of the structure in which such transmission of the load is driven by other permanent means (such as grout or elastomeric filler) Base or for permanent transmission of vertical loads in which no other transmission medium required vertical load.

The invention in the preferred form includes horizontal flat plates bearing at the top and bottom vertical precast concrete positioned with such accuracy and tolerance with respect to the vertical separation in a particular component and to ensure fulfillment acceptable vertical alignment (leveling and height) of the structure is maintained during and after erection without the use of wedges or monitoring field leveling."

The U.S. Pat. No. 3,778,528 shows "precast building module substantially all plastic construction which may comprise a housing unit of whole rooms or more thereof. The module is made in a nearly finished state ready for delivery to a construction site for final assembly and finishing. The module has walls, floor, roof and interior partitions can include the section of the unit into a plurality of rooms and household plumbing and windows and doors. The walls, floor and roof are formed from inner and outer layers of reinforced plastic molding. An insulating core of polyurethane foam material is sandwiched between the shells. All heating, ventilation, air conditioning electrical and/or gas conduits, junction boxes, terminals and the like may be provided on the insulated core in place and ready to connect and use in the construction site. A method is also provided for forming the building unit module."

The U.S. Pat. No. 3,898,776 shows "A couple of precast concrete buildings are joined together to form a modular concrete home. Each unit includes a concrete building floor slab, vertical load bearing exterior walls connected with the perimeter of the floor slab and molded integrally with the top of the outer walls sloping roof. Building units are arranged so that each unit meeting roof slopes upward toward the other unit, with the ends of the raised roof to form a roof of V-shaped passage inverted. The interior walls are cast integrally with the exterior walls and roof to divide the building units in separate rooms. The lower parts of the interior walls are spaced above the floor slab, so no loads are transmitted to the floor slab the walls, and plumbing and wiring running through the space between the bottoms of interior walls and wrought. A reinforcement cage formed from welded wire mesh is embedded in each outer wall."

The U.S. Pat. No. 3,952,465 shows "A building constructed mainly of a series of modular units joined together permanently. Several different forms of units are provided, and units of different shapes can be arranged in several different relationships with each other to provide a selection of floor plans. Each unit is a rigid structure having a floor slab part and one or more wall portions integrally connected to the flat plate portion and increasing the entire height of the story, at least some wall portions most units is offset laterally inwardly from the edges of the flat plate portion. When several units of the same story are assembled in side by side relationship, the side wall or part of a unit cooperating with the wall portion or portions of one or more additional units to provide an enclosure which constitutes a room. The portions of the floor immediately above history rest on the upper edges of the wall portions of the history immediately below. A suitable roof structure is provided in assembled units, and several special or additional units are used to provide stairways, hallways, or other special situations. Accessories adequate plumbing and kitchen appliances are preferably installed in the modular units of the factory where the units are made so that only a few connections need to be completed on site when the units are assembled to make the structure habitable building, in order to bring the pipes and cooking equipment in full working order."

The U.S. Pat. No. 4,195,453 shows "modular multi-story buildings where each floor has a plurality of semi-boxes are poured concrete as separate rigid units that are basically rectangular, comprising walls perpendicular to each other, but no floor or roof. The semi-boxes are arranged between the horizontal concrete slabs that function as both floors and roofs, and a plurality of vertical post tensioning tendons pass through the semi-boxes and slabs to join the building together."

The U.S. Pat. No. 7,673,422 shows "A module building has an open box structure and comprises a plurality of interconnected modules coaxial segments. Each segment is molded as an open box structure of a composite material. The segments are held together by elongated rods connection forming part of a lifting frame and which extend substantially along the length of the module. The lifting frame comprises end racks that are embedded in end portions of the modules and which are connected together by columns."

The U.S. Pat. No. 2011/0265395 shows "An earthquake shelter comprising a container size for human occupation, the container has walls and an access opening and a main door can be opened and closed quickly to cover and uncover the opening, the container walls and the door panel material has high strength in excess of 10,000 psi load resistor; container supports for sliding movement compensation for earthquake induced movement of a support surface, the shock or impact absorbing damping means inside the vessel, to cushion sudden movement of an occupant relative to the container as the container is suddenly brought by an earthquake conveys strength."

Notes:

However, most of the precast units are internal voids. Partitions inserted into the damaged units in mixed areas caused by the vibrations of transport and other forces. Our modules comprise a floor perimeter walls and interior walls cast as an integral unit. Later, a precast concrete roof is introduced to complete the unit. Allowing the interior walls to be molded into the module, instead of inserting them, improves vibration resistance, while minimizing joint to be sealed. These modules can have multiple spatial configurations. This breaks the idea of creating a module to use.

Objectives of Invention

A. A goal would be to build a fast, efficient and high quality module.

B. Another objective would be to provide modules to be used more efficiently, producing more units per day at low cost.

C. Another objective would be to provide a single module structure for a unit that can be managed with a team of construction of low capacity.

DESCRIPTION OF THE DRAWINGS

FIG. A-1: Slab of precast module

FIG. A-2: Vertical structural wall with the screw position

Figure 1:
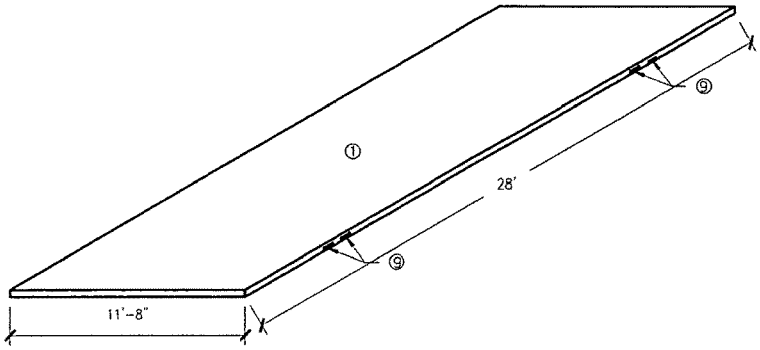
Figure 2:
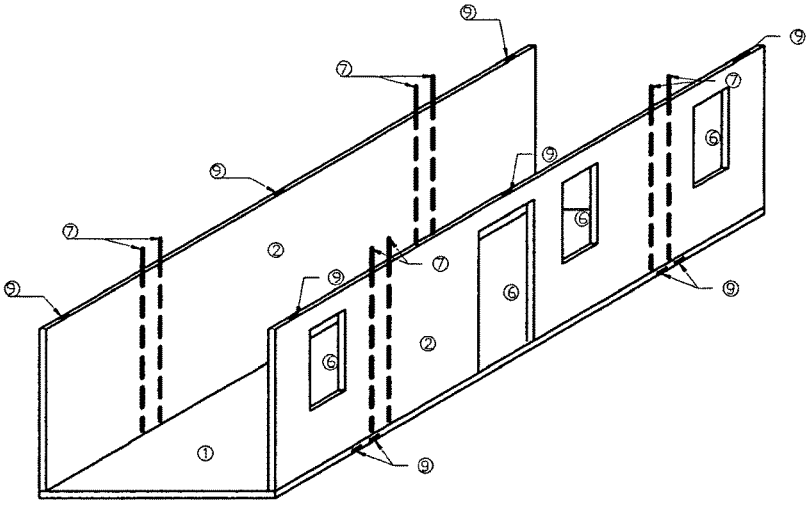
Figure 3:
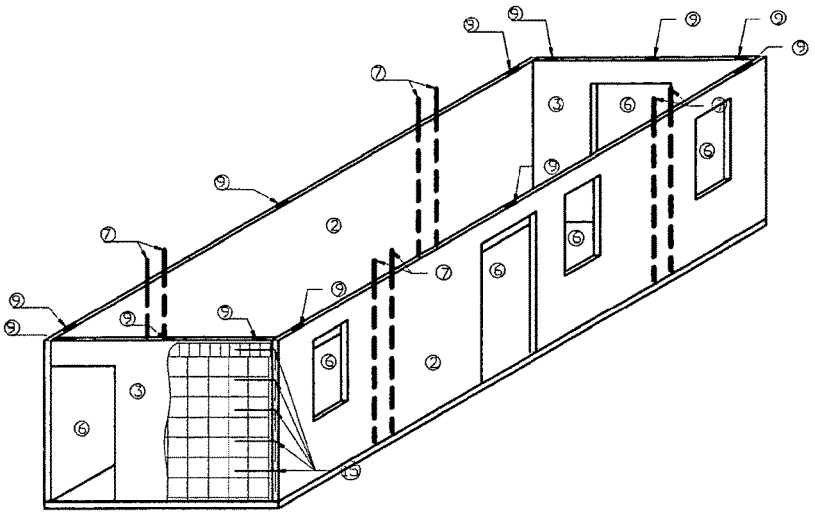
Figure 4:
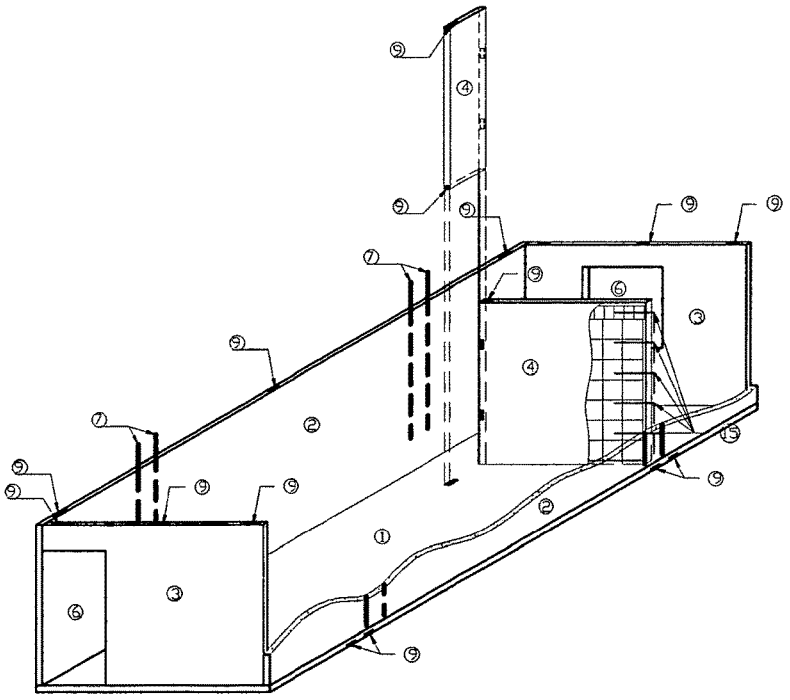
Figure 5:
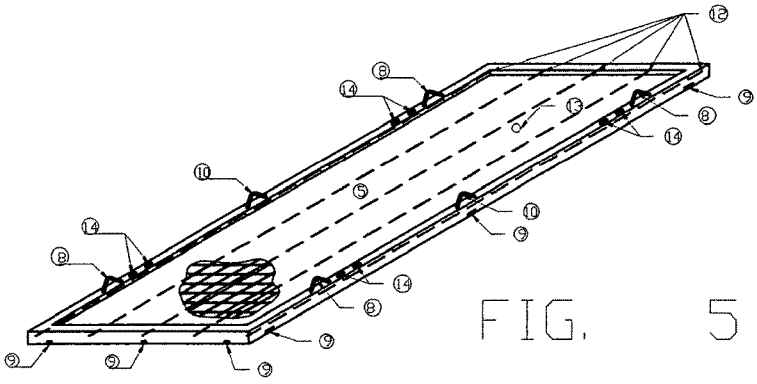
Figure 6:
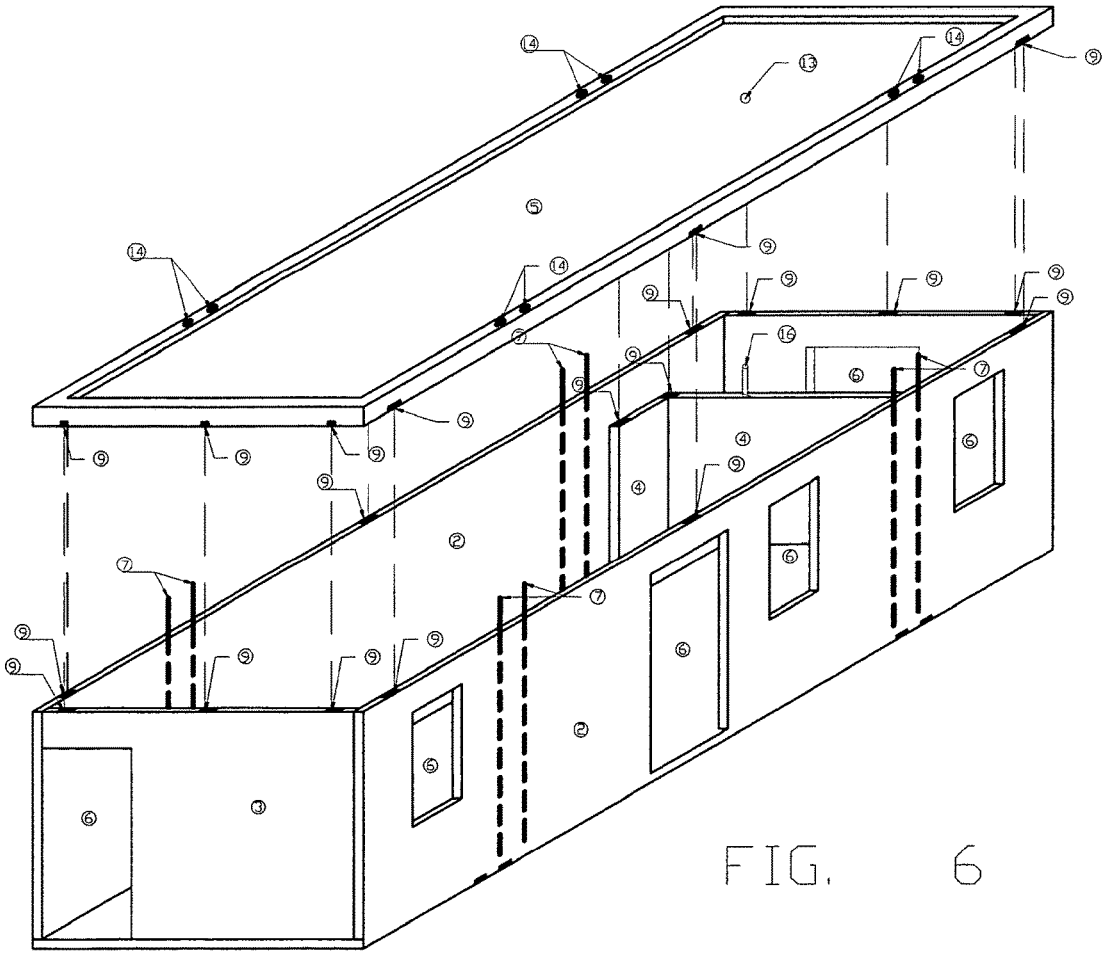
Figure 7:
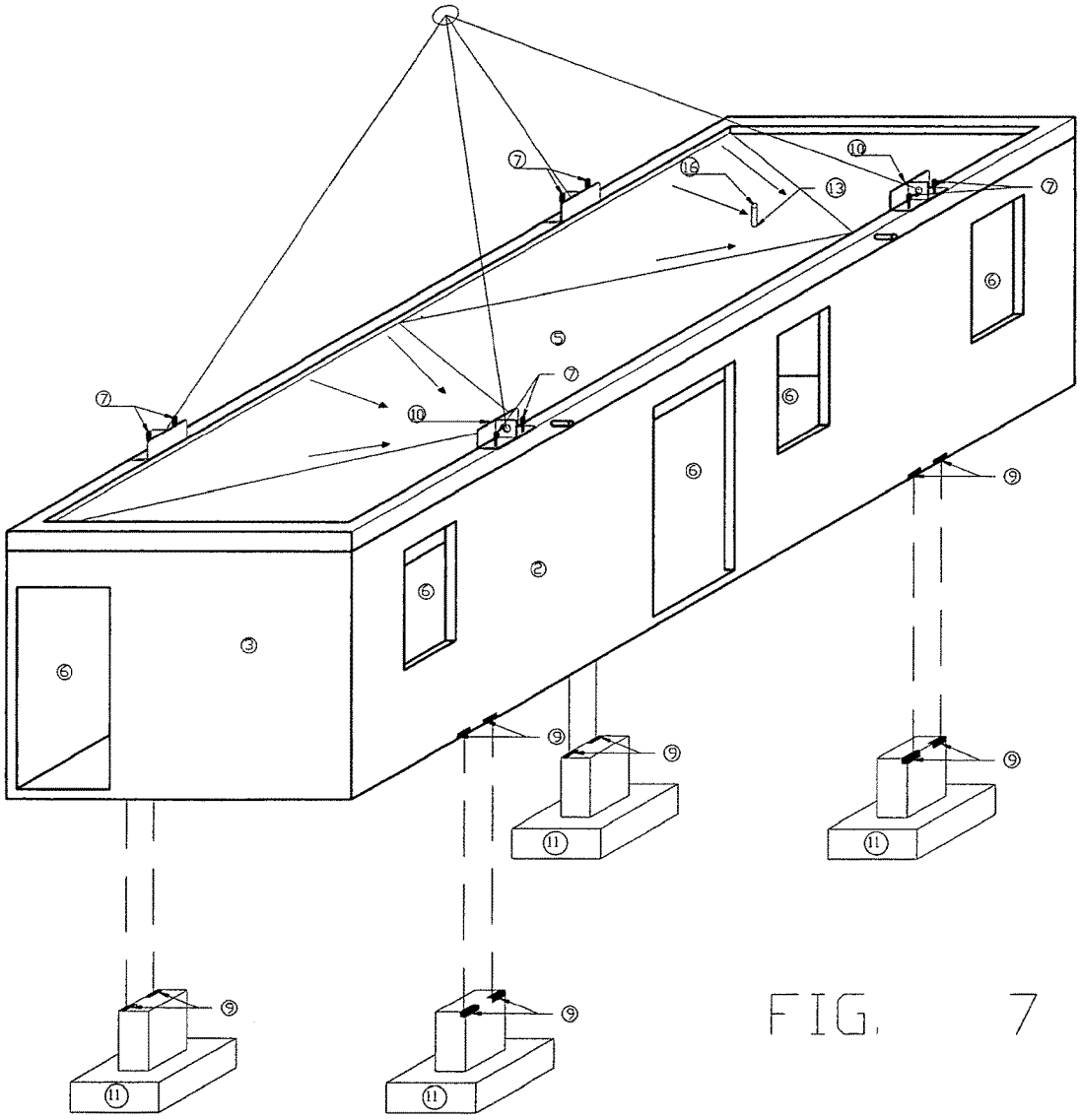
Figure 8:
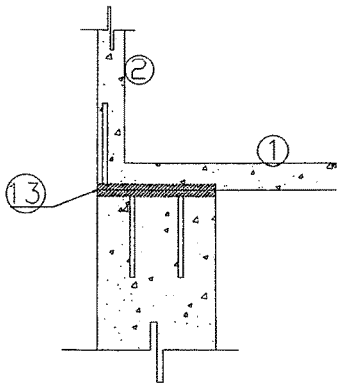
Figure 9:
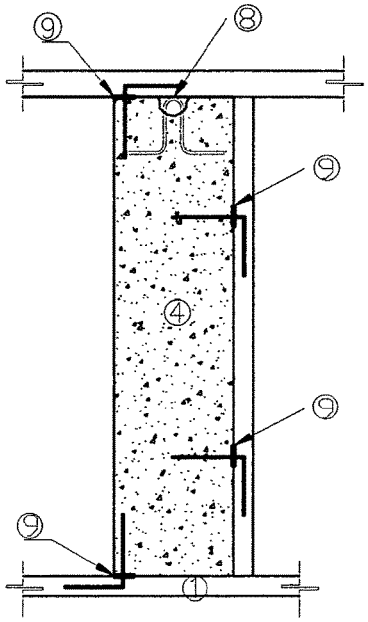
Figure 10:
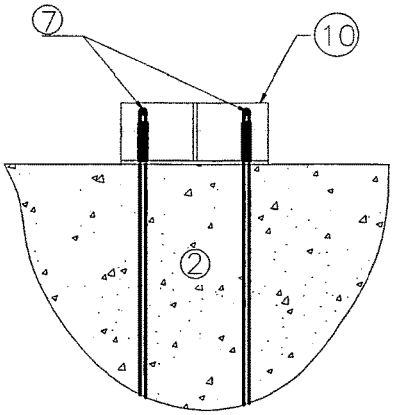
Figure 11:
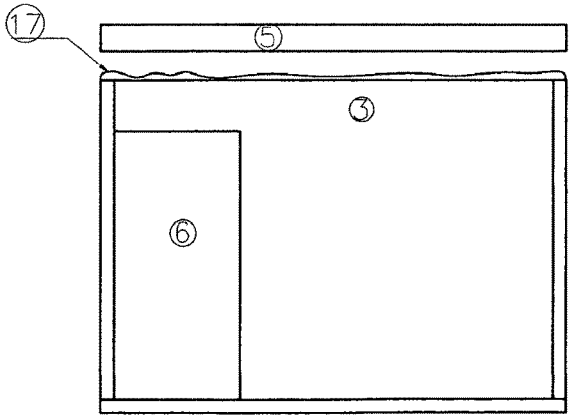

FIG. A-3: Horizontal walls with detail of the attachments

FIG. A-4: Precast interior walls

FIG. A-5: Precast concrete roof

FIG. A-6: Precast concrete roof connecting with the rest of the module

FIG. A-7: Connection modules foundation system

FIG. A-8: Connection details at foundation system modules

FIG. A-9: Details of the inner wall

FIG A-10: Details of the lifting plate

FIG. A-11: Connection details of roof and wall

| Guide | |
|---|---|
| 1. | Horizontal slab (floor) |
| 2. | perimeter of vertical walls |
| 3. | perimeter of horizontal Wall |
| 4. | Interior Wall welding |
| 5. | Pre-stressed roof |
| 6. | openings |
| 7. | Screws |
| 8. | Hooks |
| 9. | Welding plate |
| 10. | lift plate |
| 11. | foundation pier |
| 12. | cable |
| 13. | hole for vent pipe |
| 14. | hole for screw |
| 15. | Dowels |
| 16. | Vent pipe |
| 17. | Roof sealer |

To avoid confusion, the numbers shown in the illustrations are referenced in the caption above.

To start building the module, the floor slab (1) is made after inserting the welding plates (9) to be used (FIG. A-1). The position of the welding plates available depends on the spatial configuration and the base. After the perimeter of vertical walls (2) with several openings are then manufactured with welding plates (9) are inserted to 18" at each end of the wall and one in the center of the wall to the roof fitting (5) and screws (7) to the lifting plate (10) (FIG. a-2). the perimeter of the horizontal wall (3) with various opening (6) is connected to the perimeter of the vertical wall (2) to bring closer (15) and welding plate (9) the same way as the vertical wall (2) (FIG. a-3) and the inner wall (4) is welded in the floor slab (1) (FIG. a-4 is also inserted).

Welding the plates of the inner wall (4) (FIG. A-4) are inserted. Each inner wall has a welding plate (9) at the bottom to the floor slab (1) of low bandwidth, the top is connected to the roof (5) and on the side wall is connected adjacent (FIG. A-4). The welding plates 18 are placed side "of the lower and upper edge. At the top there is a hook (8) which is inserted to allow movement of said wall in place (FIG. A-9). Once the wall welded lace, gap left for the hook (8) is filled with mortar bonding agent or another. Retaining walls that are welded in place allows for different spatial configurations and unconventional partitions.

FIG. A-5, the roof (5) is constructed separately, welding plates are inserted (9) in the bottom of the roof in the same position all walls are inserted and is formed by the grid system of steel conventional reinforcement, and 5½" thickness. Roof consisting of pre-stressed cables (12). These cables (12), as shown in FIG. a-5, are pre-stressed 4.500 lbs. addition of the cables (12) improves the tensile strength of the concrete shell, thereby avoiding cracks and leakage caused by the module transportation and other sources of damage. After pouring the concrete roof (5) is ready for installation, each wire (12) is cut as close as possible to the roof.

The roof (5) is provided with holes for the screws (14) to pass through the roof to allow attachment to the upright walls (2) (FIG. A-5). The roof (5) also contains holes for ventilation tubes (13) to comply with existing building codes (FIG. A-5). Hooks (8) are placed one meter from each end of the side surface of the roof (5) and on each side of the center of said roof. These hooks (8) are only used for roof installation (5) a unit. Once installed, the hooks (8) are removed. Lifting plate (10) is used both for fixing the roof and elevation of the module (FIG. A-7). These lifting plates (10) are located in each screw (7) in position. As illustrated in FIG. A-10 each lifting plate (10) has two holes oriented vertical to the bolt (7) passing through, and a horizontal oriented hole (10) for lifting the module (FIG. A-7).

During the roof (5) of the installation, a bonding agent (17) is applied on the upper edge of the walls as shown (FIG. A-11) to fill the gaps between said walls and roof. Once set, the excess adhesive agent (17) is removed and welded plates (9) are welded. Once the roof (5), as described above, is installed, the module is ready for desirable aesthetic appearance.

Once the module is finished, it is transported to its final destination. Once at the site, is welded to the pillar of the corresponding foundation (11) (FIG. A-7 and FIG. A-8) for welding. The welding plates (9) to be placed in exact position on the surface.

Caveat

Although the present invention has been illustrated by a detailed description of several preferred embodiments thereof, it will be obvious to those skilled in the art that various changes in form and detail may be made therein without departing from the true scope of the invention. Therefore, the invention should be measured by its appended claims and not by the preferred embodiments above.

PATENT CITATIONS

| Cited patent | Filing date | Publication date | Applicant | Title |
|---|---|---|---|---|
| U.S. Pat. No. 3,201,907 | Dec. 5, 1956 | Aug. 24, 1965 | Albert Henderson | Precast segmental building units |
| U.S. Pat. No. 3,356,183 | Apr. 9, 1969 | Aug. 3, 1971 | Henry Zachary | Precast Rooms |
| U.S. Pat. No. 3,729,875 | Dec. 17, 1970 | May 1, 1973 | R. Felson | Prefabricated building |
| U.S. Pat. No. 3,742,660 | Mar. 3, 1972 | Jul. 3,1973 | R. Bierweiler | Building construction |
| U.S. Pat. No. 3,778,528 | Mar. 27, 1972 | Dec. 11, 1972 | Mandelbaum, Heifetz | Modular building unit and method for making same |
| U.S. Pat. No. 3,898,776 | Jul. 2, 1973 | Aug. 12, 1975 | Cox Elmer, Tiner Wayne, Woods Jr | Precast concrete housing |
| U.S. Pat. No. 3,952,465 | Mar. 19, 1971 | Mar. 27, 1976 | Dominic Masiello | Building structure formed of modular units with cantilevered portions for forming a corridor floor |
| U.S. Pat. No. 4,195,453 | Nov. 9, 1977 | Mar. 1, 1980 | August Komendant | Modular, multi-floor building |
| U.S. Pat. No. 4,606,878 | Feb. 4, 1985 | Aug. 19, 1986 | James D. Day, D. Day II James | Method for constructing modular precast concrete buildings |
| U.S. Pat. No. 5,893,241 | Jan. 5, 1998 | Mar. 13, 1999 | Michael P. Schoeder | Precast concrete target house |
| U.S. Pat. No. 7,673,422 | Nov. 23, 2005 | Mar. 9, 2010 | Peter William De La Marche | Modular Buildings |
| US2011/0265395 | Mar. 30, 2010 | Nov. 3, 2011 | Sidney S. Chen | Earthquake shelter |

| Referenced by | | | | |
|---|---|---|---|---|
| Cited patent | Filing date | Publication date | Applicant | Title |
| U.S. Pat. No. 2,202,745 | Mar. 8, 1938 | Mar. 28, 1940 | Robert Muse | Building construction |
| U.S. Pat. No. 2,691,291 | Aug. 2, 1949 | Oct. 12, 1954 | Albert Henderson | Building of precast concrete segments |
| U.S. Pat. No. 3,356,183 | Aug. 4, 1966 | Dec. 5, 1967 | Noah Shell | Retractable refuse receptacle assembly |
| U.S. Pat. No. 3,564,795 | Jul. 25, 1968 | Feb. 23, 1971 | Jesse Henton | Precast modular building units with utility ducts |
| U.S. Pat. No. 3,805,461 | Oct. 10,1972 | Apr. 23, 1974 | A.Jagoda | Modular building system |
| U.S. Pat. No. 3,842,558 | May 30, 1972 | Oct. 22, 1974 | Scholz Fuller | Wall attachment system |
| U.S. Pat. No. 3,882,649 | 27 Apr. 1973 | May 13, 1975 | Walk Jones, William Lemessurier, Francis Mah | Interlocked modular building system |
| U.S. Pat. No. 3,990,197 | Mar. 15, 1976 | Nov. 9, 1976 | Clifford Johnson | Liftable wooden frame building unit and method of construction |
| U.S. Pat. No. 4,279.536 | Mar. 7, 1979 | Jul. 21, 1981 | Gerard Jarlan | Flow-guiding monolithic blocks for marine structures |
| U.S. Pat. No. 4,539,780 | Nov. 29, 1983 | Sep. 10, 1985 | William Rice | Storm Cellar or the like |

What is being claimed:

1. A precast concrete module comprising:

a horizontal slab, perimeter walls, at least one welding plate, and at least one interior wall cast as a first integral unit;

a pre-stressed concrete roof and a second welding plate cast as a second integral unit separately from the first integral unit;

wherein each of at least two opposing perimeter walls comprise a screw that extends vertically throughout and beyond each said at least two opposing perimeter walls;

wherein each screw of said at least two opposing perimeter walls extends vertically and beyond the pre-stressed concrete roof.

2. A precast concrete module as in claim 1, wherein the pre-stressed concrete roof comprises at least a lift plate that attaches to each screw of said at least two opposing perimeter walls;

wherein said at least a lift plate comprises a vertical oriented hole for module lifting.

3. A precast concrete module as in claim 1, wherein the first at least one welding plate is attached to a foundation pier.

4. A precast concrete module as in claim 1, wherein at least a perimeter wall comprises a third welding plate; and wherein the third welding plate is attached to the second at least one welding plate.

5. A precast concrete module as in claim 1, comprising holes for ventilation and plumbing pipes.

6. A precast concrete module as in claim 1, wherein the pre-stressed concrete roof contains hooks.

7. A precast concrete module as in claim 1, wherein the pre-stressed concrete roof is in a sloped position relative to the horizontal slab.

* * * * *